US009128497B2

(12) United States Patent
Li et al.

(10) Patent No.: US 9,128,497 B2
(45) Date of Patent: Sep. 8, 2015

(54) VOLTAGE REFERENCE CIRCUIT BASED ON TEMPERATURE COMPENSATION

(75) Inventors: Ting Li, Nan'an District (CN); Zhengfan Zhang, Nan'an District (CN); Mingyuan Xu, Nan'an District (CN); Yuxin Wang, Nan'an District (CN); Tao Liu, Nan'an District (CN)

(73) Assignee: China Electronic Technology Corporation, 24th Research Institute, Nan'an District, Chongqing (CN)

( * ) Notice: Subject to any disclaimer, the term of this patent is extended or adjusted under 35 U.S.C. 154(b) by 205 days.

(21) Appl. No.: 13/993,117

(22) PCT Filed: Aug. 24, 2011

(86) PCT No.: PCT/CN2011/078830

§ 371 (c)(1),
(2), (4) Date: Aug. 26, 2013

(87) PCT Pub. No.: WO2013/016884

PCT Pub. Date: Feb. 7, 2013

(65) Prior Publication Data

US 2013/0328620 A1 Dec. 12, 2013

(30) Foreign Application Priority Data

Jul. 29, 2011 (CN) ..... 2011 1 0216587

(51) Int. Cl.
*G05F 3/02* (2006.01)
*G05F 3/30* (2006.01)

(52) U.S. Cl.
CPC ... *G05F 3/02* (2013.01); *G05F 3/30* (2013.01)

(58) Field of Classification Search
USPC ..... 323/312–316; 327/512–513, 538–543
See application file for complete search history.

(56) References Cited

U.S. PATENT DOCUMENTS

| | | | | |
|---|---|---|---|---|
| 5,352,973 | A * | 10/1994 | Audy | 323/313 |
| 7,166,994 | B2 * | 1/2007 | Lee et al. | 323/313 |
| 2003/0201822 | A1 | 10/2003 | Kang et al. | |
| 2007/0046363 | A1 | 3/2007 | Tanzawa | |
| 2009/0121699 | A1 | 5/2009 | Park et al. | |

FOREIGN PATENT DOCUMENTS

| | | | |
|---|---|---|---|
| CN | 101013331 | A | 8/2007 |
| CN | 101042591 | A | 9/2007 |
| JP | 2007-058772 | A | 3/2007 |

OTHER PUBLICATIONS

International Search Report for corresponding International Patent Application No. PCT/CN2011/078830 mailed Aug. 24, 2011.

* cited by examiner

*Primary Examiner* — An Luu
(74) *Attorney, Agent, or Firm* — Merchant & Gould P.C.

(57) ABSTRACT

The present invention pertains to a voltage reference circuit based on temperature compensation, comprising positive and negative temperature coefficient generating units, temperature compensation circuit, image circuit and voltage divider. In this circuit, Item T is compensated with Item T, and Item T ln(T) is compensated by Item T in (T), which features a well-targeted compensation performance. The circuit outputs a reference voltage with zero temperature coefficient, which is independent to T and T ln (T). The output voltage value could be defined by adjusting the ratio of resistance in voltage divider. The invention provides a voltage reference circuit featuring good compensation, zero temperature coefficient and adjustable output voltage. The invention has a better compensation than the conventional one and a fixed output voltage, and it totally eliminates the temperature coefficient. The invention has wide application in analog IC and digital/analog mixed IC.

8 Claims, 3 Drawing Sheets

VOLTAGE REFERENCE CIRCUIT BASED ON TEMPERATURE COMPENSATION

This application is a National Stage Application of PCT/CN2011/078830, filed 24 Aug. 2011, which claims benefit of Serial No. 201110216587.6, filed 29 Jul. 2011 in China and which applications are incorporated herein by reference. To the extent appropriate, a claim of priority is made to each of the above disclosed applications.

TECHNICAL FIELD

The present invention relates to a voltage reference circuit, specifically a voltage reference circuit based on temperature compensation, applicable for analog IC's and ditigal-analog mixed IC's where reference voltage with low temperature coefficient is required.

BACKGROUND ART

A voltage reference circuit with low temperature coefficient is an essential part for analog IC. The circuit generates low temperature coefficient voltage by weighted summing of positive and negative temperature coefficient voltages to reduce variation of the reference voltage with temperature. The conventional voltage reference is generated by weighted summing of difference in PN junction voltages of bipolar transistors with positive and negative temperature coefficients, as shown in FIG. 1 (the temperature coefficient of resistor is neglected), and operational amplifier AO enables voltages at g0 and f0) to be equal, as $I_{C_{Q10}}R_{30}=I_{C_{Q20}}R_{20}$, then:

$$V_{REF} = V_{BE_{Q10}} + \Delta V_{BE_{Q10,Q20}} \cdot \frac{R_{20}}{R_{10}} \tag{1}$$

Where $V_{BE}$ is PN junction voltage of bipolar transistor Q10, and $\Delta V_{BE_{Q10,Q20}}$ is the PN junction voltage difference between Q10 and Q20.

$$V_{BE} = V_T \ln\left(\frac{I_C}{I_S}\right) = \frac{kT}{q}\ln\left(\frac{I_C}{b \cdot T^{2.5} \cdot e^{\frac{-E_g}{kT}}}\right) \tag{2}$$

Where k is Boltzmann constant, T is absolute temperature, q is the quantity of electron, $I_C$ is the collector current of bipolar transistor, b is a proportional coefficient and $E_g$ is Si bandgap energy.

From Equation (2), the following could be derived:

$$\Delta V_{BE_{Q10,Q20}} = V_T \ln\left(\frac{I_{C_{Q10}}}{I_S}\right) - V_T \ln\left(\frac{I_{C_{Q20}}}{n_0 I_S}\right) = V_T \ln\left(n_0 \frac{I_{C_{Q10}}}{I_{C_{Q20}}}\right) = \frac{k\ln\left(n_0 \frac{R_{20}}{R_{30}}\right)}{q} \cdot T \tag{3}$$

Where k is Boltzmann constant, T is absolute temperature, q is the quantity of electron, $n_0$ is the ratio of the number of bipolar transistor Q20 to Q10.

From Equation (2) & (3), the following could be derived:

$$V_{BE_{Q10}} = \frac{E_g}{q} + \frac{kT}{q}\ln\left(I_{C_{Q10}}\right) - \frac{2.5k}{q}T\ln(T) - \frac{k\ln(b)}{q}T \tag{4}$$

Where $$I_{C_{Q10}} = \frac{I_{C_{Q20}}R_{20}}{R_{30}} = \frac{\Delta V_{BE_{Q10,Q20}}}{R_{10}} \cdot \frac{R_{20}}{R_{30}} = \frac{kR_{20}\ln\left(n_0 \frac{R_{20}}{R_{30}}\right)}{qR_{10}R_{30}} \cdot T \tag{5}$$

Then, $$V_{BE_{Q10}} = \frac{E_g}{q} + \frac{k\ln\left(\frac{kR_{20}\ln\left(n_0 \frac{R_{20}}{R_{30}}\right)}{qbR_{10}R_{30}}\right)}{q} \cdot T - \frac{1.5k}{q} \cdot T\ln(T) \tag{6}$$

From Equations (1),(3) and (6):

$$V_{REF} = \frac{E_g}{q} + \frac{k\ln\left(\frac{kR_{20}\left(n_0 \frac{R_{20}}{R_{30}}\right)^{\frac{R_{20}}{R_{10}}}\ln\left(n_0 \frac{R_{20}}{R_{30}}\right)}{qbR_{10}R_{30}}\right)}{q} \cdot T - \frac{1.5k}{q} \cdot T\ln(T) \tag{7}$$

It can be seen from Equations (3) and (6), $\Delta V_{BE_{Q10,Q20}}$ is related to T, and $V_{BE_{Q10}}$ is not only relevant to T, but also to T ln(T). Therefore, when $\Delta V_{BE_{Q10,Q20}}$ is added to $V_{BE_{Q10}}$, only T-related item can be used to compensate for T ln(T)-related item, as shown in Equation (7). For conventional voltage reference circuits, the reference voltage $V_{REF}$ is always associated to T and T ln(T), which means that the temperature coefficient of the reference voltage can never be fully eliminated. Temperature coefficient of the conventional voltage reference source using standard process technology is 40 ppm/° C., namely, in the temperature range from −40° C. to 85° C., variation of the reference voltage can be calculated from:

$$40\ \text{ppm/°C} \times [85°\text{C} - (-40°\text{C})] \times 100\% = 0.5\%.$$

Therefore, a voltage reference circuit with zero-temperature coefficient based on temperature compensation is required to eliminate effects of T and T ln(T) and solve the problem of inability of temperature coefficient elimination due to the dependence of output reference voltage from the conventional voltage reference source on T and T ln(T).

Contents of Invention

The object of the present invention is to eliminate effects of T and T ln(T) and generate reference voltage with zero-temperature coefficient based on temperature compensation, so as to solve the problem of inability of temperature coefficient elimination due to the dependence of output reference voltage from the conventional voltage reference source on T and T ln(T).

The present invention accomplishes the object in the following way:

The present invention presents a voltage reference circuit based on temperature compensation, which comprises a positive temperature coefficient generating unit, a negative temperature coefficient generating unit, temperature compensaion circuit, mirror circuit and voltage divider circuit;

The positive temperature coefficient generating unit generates a positive temperature coefficient voltage with Item T ln (T), and outputs a positive temperature coefficient current with both Items T and T ln (T);

The negative temperature coefficient generating unit generates positive temperature coefficient voltage with both Items T and T ln (T), and outputs positive temperature coefficient current with Item T;

The temperature compensation circuit converts the positive temperature coefficient current with both Items T and T ln (T) into positive temperature coefficient voltage with both Items T and T ln (T), and compensates the negative temperature coefficient voltage with both Items T and T ln (T) from negative temperature coefficient generating unit. The negative temperature coefficient generating unit, together with temperature compensation circuit, generates reference voltage with zero temperature coefficient;

Where T is absolute temperature;

The mirror circuit multiplies output current from the negative temperature coefficient generating unit by a factor of m, which is then input to the positive temperature coefficient generating unit;

The voltage divider adjusts output voltage and defines operating voltage of both positive and negative temperature coefficient generating units.

Furthermore, the temperature compensation circuit comprises resistor R5, the positive temperature coefficient generating unit comprises operational amplifier A1, bipolar transistors Q3 and Q4, resistors R6 and R4, where the positive input of A1 is connected to the base of Q4, while the negative input of A1 is connected to the collector of Q4, and the output of A1 is connected to the emitter of Q4, one end of R6 is connected to the negative input of A1 and the collector of Q4, and the other end of R6 is grounded, between emitters of both Q4 and Q3 is R4, the collector of Q3 is connected to mirror circuit, and the base of Q3 is connected to the base of Q4;

Furthermore, the negative temperature coefficient generating unit comprises operational amplifier A2, bipolar transistors Q1 and Q2, and resistors R1, R2 and R3, where the emitter of Q1 is connected to the positive input of A2, which is connected to R3, the emitter of Q2 is connected via R1 with the negative input of A2, which is connected to R2, the output of A2 is connected to resistor R5, of which the other end is connected with R2 and R3, the other end of R2 is connected to the emitter of Q3, collectors of both Q1 and Q2 are connected with mirror circuit, and the output of A2 is connected to voltage divider;

Furthermore, the mirror circuit comprises the first NMOS transistor M1 and the second NMOS transistor M2, of which the sources are grounded, the gates of both M1 and M2 are connected together, the gate of M2 is connected to its drain, the drain of Ml is connected to the collector of Q3, and the gate of M2 is connected to collectors of both Q1 and Q2;

Furthermore, the voltage divider comprises resistors R7 and R8, where R8 is connected with the output of operational amplifier A2, while the other end of R8 is connected with R7 and bases of Q1, Q2, Q3 and Q4, the other end of R7 is connected to the sources of M1 and M2, and the connection nodes of operational amplifier A2 with R5 and R8 are the output ports, Vo, of the voltage reference circuit;

Furthermore, the output reference voltage value is determined by the ratio of R7 to R8: $V_o=(E_g/q)\cdot(1+R_7/R_8)$ where $(E_g/q)$ is Si bandgap voltage. Different output reference voltages can be obtained by adjusting the ratio of R7 to R8.

Furthermore, R4 and R5 has the following relation:

$$\frac{R_5}{R_4}=\frac{3}{2};$$

Furthermore, the negative temperature coefficient generating unit comprises at least one bipolar transistor Q1 and at least one bipolar transistor Q2, and the ratio of the number of Q2 to Q1 is n. The positive temperature coefficient generating unit comprises at least one bipolar transistor Q3 and at least one bipolar transistor Q4, and the ratio of the number of Q4 to Q3 is p. The mirror circuit comprises at least one first NMOS transistor M1 and one second NMOS transistor M2, where n>1 and p>1.

Compared with the conventional voltage reference source, the voltage reference circuit based on temperature compensation in this invention features:

1 . The conventional voltage reference uses Item T to compensate Item T ln(T), while the present invention uses Item T to compensate Items T, and T ln (T) to compensate T ln (T), which makes the compensation more specific.

2 . In the conventional voltage reference circuit, Item T ln(T) is compensated by Item T, so the output reference voltage is ralated to both T and T ln(T), which makes it impossible to completely eliminate temperature coefficient (about 40 ppm/° C.). The present invention outputs a reference voltage independent to T and T ln(T), so, it is capable of delivering a reference voltage with zero-temperature coefficient.

3 . The output voltage range of the conventional voltage reference circuit is the bandgap voltage of silicon, therefore, the output voltage is a fixed value. The present invenion offers a voltage reference $V_o=(E_g/q)\cdot(1+R_7/R_8)$, which is defined flexibly by adjusting the ratio of resistor R7 to R8, so the circuit is capable of delivering any output voltage value within a certain range.

To sum up, the present invention has the advantages of well-targeted compensation, zero-temperature coefficient and adjustable output voltage values.

Other advantages, objects and features of the present invention will be elaborated in the subsequent embodiments, and may be best understood by referring to the following description of the presently preferred embodiments, together with the accompanying drawings.

DESCRIPTION OF DRAWINGS

To better understand the objects, technologies and advantages of the present invention, the accompanying drawings are referred to for further description, wherein.

SPECIFIC MODE FOR CARRYING OUT THE INVENTION

The embodiments of the present invention are described in detail and illustrated with attached drawings. It should be understand the following embodiments are only intended to illustrate the invention, not to limit the claims.

Embodiment 1

Figure 1:
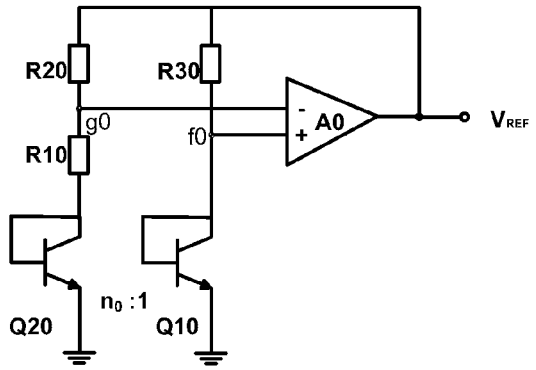
FIG. 1 is a diagram of the conventional voltage reference circuit.
Figure 2:
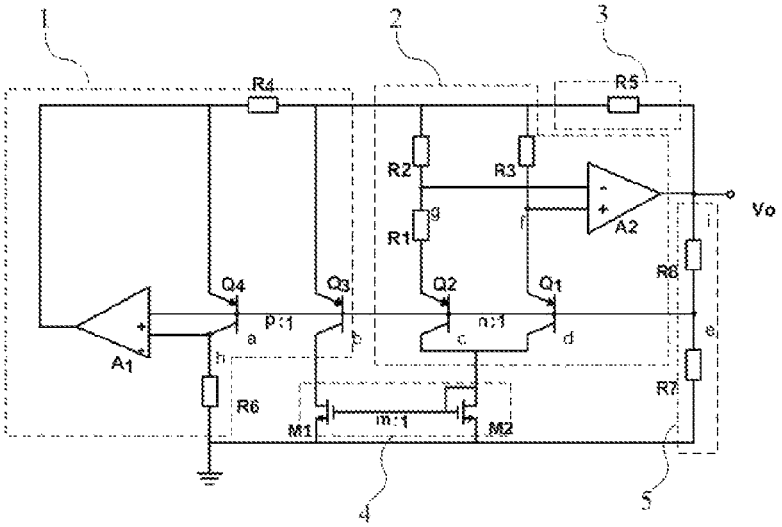
FIG. 2 is a diagram of Embodiment 1 of the voltage reference circuit based on temperature compensation in the present invention.

FIG. 2 is the diagram of Embodiment 1 of the voltage reference circuit based on temperature compensation in the present invention, as shown in FIG. 2: the present invention provides a voltage reference circuit based on temperature compensation, comprising a positive temperature coefficient generating unit 1, a negative temperature coefficient generating unit 2, a temperature compensation circuit 3, mirror circuit 4 and a voltage divider 5;

The positive temperature coefficient generating unit 1 generates a positive temperature coefficient voltage with Item T ln(T) and outputs a postive temperature coefficient current with Items T and T ln(T);

The negative temperature coefficient generating unit 2 generates a negative temperature coefficient voltage with Items T and T ln (T) and outputs a positive temperature coefficient current with Item T;

The temperature compensation circuit 3 converts the positive temperature coefficient current with Items T and T ln (T) into positive temperature coefficient voltage with Items T and T ln (T) and compensates the negative temperature coefficient voltage with Items T and T ln (T) from negative temperature coefficient generating unit. The negative temperature coefficient generating unit works together with temperature compensation circuit to generate reference voltage with zero temperature coefficient;

Where, T is absolute temperature;

The mirror circuit 4 multiplies the output current from the negative temperature coefficient generating unit by a factor of m, which is then input to the positive temperature coefficient generating unit;

The voltage divider 5 adjusts output voltage and defines operating voltages of both positive and negative temperature coefficient generating units.

As further improvements for above embodiment, the temperature compensation circuit comprises resistor R5, the positive temperature coefficient generating unit comprises operational amplifier Al, bipolar transistors Q3 and Q4, and resistors R6 and R4, wherein the positive input of A1 is connected to the base of Q4, the negative input of A1 is connected to the collector of Q4, the output of A1 is connected to the emitter of Q4, one end of R6 is connected to the negative input of A1 and the collector of Q4, and the other end of R6 is grounded, In between emitters of Q4 and Q3 is R4, the collector of Q3 is connected to mirror circuit, and the base of Q3 is connected with the base of Q4;

As further improvements for above embodiment, the negative temperature coefficient generating unit comprises operational amplifier A2, bipolar transistors Q1 and Q2, resistors R1, R2 and R3, wherein the emitter of Q1 is connected to the positive input of A2, which is connected to R3, the emitter of Q2 is connected via R1 with the negative input of A2, which is connecte to R5, and the other end of R5 is connected to R2 and R3, the other end of R2 is connected to the emitter of Q3, the collectors of Q1 and Q2 are connected with mirror circuit, and the output of A2 is connected to voltage divider circuit;

As further improvements for above embodiment, the mirror circuit comprises first NMOS transistor M1 and second NMOS transistor M2, wherein the source of M1 and M2 are grounded, the gate of M1 is connected to the gate of M2, the gate of M2 is connected to the drain of M2, the drain of M1 is connected with the collector of bipolar transistor Q3, and the gate of M2 is connected with collectors of bipolar transistors Q1 and Q2;

As further improvements for above embodiment, the voltage divider comprises resistors R7 and R8, wherein R8 is connected to the output of A2, the other end of R8 is connected to R7 and also to the base of Q1, Q2, Q3 and Q4, the other end of R7 is connected to the source of M1 and M2, the connectiong node of A2 with R5 and R8 is the output port, Vo, of the reference circuit;

As further improvements for above embodiment, the output reference voltage value is determined by the ratio of R7 to R8: $V_o=(E_g/q)\cdot(1+R_7/R_8)$ where $(E_g/q)$ is the bandgap voltage of silicon. Different output reference voltages can be obtained by adjusting the ratio of R7 to R8.

As further improvements for above embodiment, R4 and R5 has the following relation:

$$\frac{R_5}{R_4}=\frac{3}{2};$$

As further improvements for above embodiment, the negative temperature coefficient generating unit comprises at least one bipolar transistor Q1 and at least one bipolar transistor Q2, wherein the ratio of the number of Q2 to the number of Q1 is n. The positive temperature coefficient generating unit comprises at least one bipolar transistor Q3 and at least one bipolar transistor Q4, wherein the ratio of the number of Q4 to the number of Q3 is p. The mirror circuit comprises at least one first NMOS transistor M1 and at least one second NMOS transistor M2, wherein the ratio of the number of first MOS transistors M1 to the number of second NMOS transistor M2 is m, where n>1, p>1.

The present invention is described in detail, including its operational principle and embodiments:

FIG. 2 shows a whole diagram of the present invention, including two op-amps A1 and A2, four bipolar transitors Q1, Q2, Q3 and Q4, two MOS transostors M1 and M2 and eight resistors R1 to R8. Nodes a, b, c, d are connections of the base of Q4, Q3, Q2 and Q1, respectively; Node e is a common connection for R7 and R8, and it connects the base of Q4, Q3, Q2 and Q1; Node f connects the positive input of A2 with the emitter of Q1, Node g is a meeting point connecting the negative input of A2 with R1 and R1, Node h connects bipolar transistor Q4 to the negative input of A1, Nnode i is the output pport of operational amplifier A2; Connections in FIG. 2 is identical with the description of the invention content, regardless of temperature coefficient of resistors and MOS transistors, the theory of operation is as follows:

The difference betweem PN junction voltage of bipolar transistors Q1 and Q2 results in a positive temperature coefficient voltage with Item T, the operational amplifier A2 causes voltages at Nodes f and g to be equal, so the voltage on R1 is:

$$V_{R1}=\Delta V_{BE1,2}=V_T\ln\left(\frac{I_{Q1}}{I_s}\right)-V_T\ln\left(\frac{I_{Q2}}{nI_s}\right)=V_T\ln\left(n\cdot\frac{R_2}{R_3}\right)=\frac{k\cdot\ln\left(n\cdot\frac{R_2}{R_3}\right)}{q}\cdot T \tag{8}$$

Where n is the ratio of the number of bipolar transistor Q2 to the number of bipolar transistor Q1.

The difference between PN junction voltage of bipolar transistors Q3 and Q4 results in a positive temperature coefficient voltage with Items T and T ln(T), e.g. voltage on R4:

$$V_{R4}=\Delta V_{BE3,4}=V_T\ln\left(p\cdot\frac{I_{Q3}}{I_{Q4}}\right)=\frac{kT}{q}\ln\left(p\cdot\frac{I_{Q3}}{I_{Q4}}\right) \tag{9}$$

Operational amplifier Al makes voltages at Nodes a and h equal, neglecting the base current of all bipolar transistors, the voltage on R6 is:

$$V_{R6} = V_{R7} = \frac{R_7}{R_8 + R_7} \cdot V_O \tag{10}$$

Then, $$I_{Q4} = I_{R6} = \frac{R_7}{(R_8 + R_7)R_6} \cdot V_O \tag{11}$$

The current mirror consisting of the first NMOS transistor M1 and second NMOS transistor M2 multiplies the sum of current at collectors of bipolar transistors Q1 and Q2 by a factor of m, which is used as the collector current of bipolar transistor Q3:

$$I_{Q3} = m \cdot (I_{Q1} + I_{Q2}) = m \cdot \left(1 + \frac{R_2}{R_3}\right) I_{Q2} \tag{12}$$

According to Equation (8):

$$I_{Q2} = \frac{V_{R1}}{R_1} = \frac{k \cdot \ln\left(n \cdot \frac{R_2}{R_3}\right)}{q \cdot R_1} \cdot T \tag{13}$$

According to Equations (12) and (13):

$$I_{Q3} = \frac{m \cdot k \cdot \ln\left(n \cdot \frac{R_2}{R_3}\right)}{q \cdot R_1} \cdot \left(1 + \frac{R_2}{R_3}\right) \cdot T = \alpha_1 \cdot T \tag{14}$$

Where $$\alpha_1 = \frac{m \cdot k \cdot \ln\left(n \cdot \frac{R_2}{R_3}\right)}{q \cdot R_1} \cdot \left(1 + \frac{R_2}{R_3}\right) \tag{15}$$

According to Equations (9), (11) and (14):

$$I_{R4} = \frac{V_{R4}}{R_4} = \frac{k}{qR_4}\left[\ln\left(\frac{\alpha_1 \cdot p \cdot R_6 \cdot (R_8 + R_7)}{R_7 \cdot V_O}\right) + \ln(T)\right] \cdot T = \alpha_2 \cdot T + \alpha_3 \cdot T\ln(T) \tag{16}$$

Where $$\alpha_2 = \frac{k}{qR_4} \cdot \ln\left(\frac{\alpha_1 \cdot p \cdot R_6 \cdot (R_8 + R_7)}{R_7 \cdot V_O}\right) \tag{17}$$

$$\alpha_3 = \frac{k}{qR_4} \tag{18}$$

According to Equations (12), (14) and (16), the current on R5 is:

$$I_{R5} = I_{Q1} + I_{Q2} + I_{Q3} + I_{R4} = \left(\frac{m+1}{m} \cdot \alpha_1 + \alpha_2\right) \cdot T + \alpha_3 \cdot T\ln(T) \tag{19}$$

Bipolar transistor Q1 generates a PN junction voltage with negative temperature coefficient containing Items T and T ln (T). According to Equation (4), the PN junction voltage of bipolar transistor Q1 is:

$$V_{BE_{Q1}} = V_T \ln\left(\frac{I_{Q1}}{I_s}\right) = \frac{E_g}{q} + \frac{kT}{q}\ln(I_{Q1}) - \frac{2.5k}{q}T\ln(T) - \frac{k\ln(b)}{q}T \tag{20}$$

Where $$I_{Q1} = \frac{R_2}{R_3} I_{Q2} \tag{21}$$

The voltage on $R8$ is:

$$V_{R8} = V_{BE_{Q1}} + V_{R3} + V_{R5} = V_{BE_{Q1}} + I_{Q2} \cdot R_2 + I_{R5} \cdot R_5 \tag{22}$$

Where $V_{R3}$ is the positive temperature coefficient voltage for R3 , and $V_{R5}$ is the positive temperature coefficient voltage containing Items T and T ln (T).

According to Equations (13) and (19)-(22), $$\begin{aligned} V_{R8} &= \frac{E_g}{q} + \frac{k}{q}\ln\left(\frac{R_2}{R_3}\frac{k \cdot l\left(n \cdot \frac{R_2}{R_3}\right)}{q \cdot R_1}\right) \cdot T - \frac{1.5k}{q} \cdot T\ln(T) - \frac{k\ln(b)}{q} \cdot T + \\ &\quad R_2 \frac{k \cdot \ln\left(n \cdot \frac{R_2}{R_3}\right)}{q \cdot R_1} \cdot T + \left(\frac{m+1}{m} \cdot \alpha_1 + \alpha_2\right) \cdot R_5 \cdot T + \alpha_3 \cdot R_5 \cdot T\ln(T) \\ &= \frac{E_g}{q} + \left\{\begin{array}{l} \frac{k}{q}\ln\left(\frac{R_2}{R_3}\frac{k \cdot \ln\left(n \cdot \frac{R_2}{R_3}\right)}{q \cdot R_1}\right) - \\ \frac{k\ln(b)}{q} + R_2 \frac{k \cdot \ln\left(n \cdot \frac{R_2}{R_3}\right)}{q \cdot R_1} + \\ \left(\frac{m+1}{m} \cdot \alpha_1 + \alpha_2\right) \cdot R_5 \end{array}\right\} \cdot T + \\ &\quad \left\{-\frac{1.5k}{q} + \alpha_3 \cdot R_5\right\} \cdot T\ln(T) \end{aligned} \tag{23}$$

To make $V_{R8}$ independent to temperature, coefficients before T and T ln (T) should be 0, then:

$$\frac{k}{q}\ln\left(\frac{R_2}{R_3}\frac{k \cdot \ln\left(n \cdot \frac{R_2}{R_3}\right)}{q \cdot R_1}\right) - \frac{k\ln(b)}{q} + R_2 \frac{k \cdot \ln\left(n \cdot \frac{R_2}{R_3}\right)}{q \cdot R_1} + \left(\frac{m+1}{m} \cdot \alpha_1 + \alpha_2\right) \cdot R_5 = 0 \tag{24}$$

$$-\frac{1.5k}{q} + \alpha_3 \cdot R_5 = 0 \tag{25}$$

According to Equations (18) and (25), $$\frac{R_5}{R_4} = \frac{3}{2} \tag{26}$$

According to Equations (23), (18) and (25), $$V_O \cdot \frac{R_8}{R_7 + R_8} = V_{R8} = \frac{E_g}{q} \tag{27}$$

Where $V_o$ is the compensated output reference voltage, and $(E_g/q)$ is the bandgap voltage of silicon.

According to Equations (15), (17), (24) and (26), $$\ln(R_1) = \ln\left(\frac{k \cdot r_{2,3} \cdot l(n \cdot r_{2,3})}{q \cdot b}\right) + \frac{3}{2} \cdot \ln\left[\frac{m \cdot p \cdot k \cdot \ln(n \cdot r_{2,3}) \cdot (1 + r_{2,3}) \cdot r_{6,1} \cdot r_{8,7}}{E_g}\right] + r_{2,1} \cdot \ln(n \cdot r_{2,3}) + r_{5,1} \cdot (m+1) \cdot (1 + r_{2,3}) \cdot \ln(n \cdot r_{2,3}) \tag{28}$$

Where $$r_{2,1} = \frac{R_2}{R_1},\ r_{5,1} = \frac{R_5}{R_1},\ r_{6,1} = \frac{R_6}{R_1},\ r_{2,3} = \frac{R_2}{R_3},\ r_{8,7} = \frac{R_8}{R_7} \tag{29}$$

When resistor ratio coefficient in Equation (29) is defined (theoretically, the ratio in Equation (29) can be any value, which can be chosen based on specific process for convenience of layout design), $R_1$ can be calculated using Equation (28). Resistance values of $R_2$, $R_3$, $R_4$, $R_5$ and $R_6$ are calculated by applying Equations (26) and (29).

The compensated output reference voltage is calculated using Equation (27):

$$V_O = \frac{E_g}{q} \cdot \left(1 + \frac{R_7}{R_8}\right) \tag{30}$$

As shown in Equation (30), the $V_o$ expression does not contain items relevant to temperature T, so the compensated output reference voltage has zero temperature coefficient; the compensated output reference voltage $V_o$ is determined by the ratio of $R_7$ to $R_3$. Therefore, different output reference voltages can be achieved by adjusting the ratio of $R_7$ to $R_8$, where the value of R7 should be chosen such that M2 operates in saturation region and bipolar transistors Q1 to Q4 operate in amplifying area. The voltage reference circuit based on temperature compensation in the present invention is fabricated in general Si-gate BiCMOS process.

Embodiment 2

Figure 3:
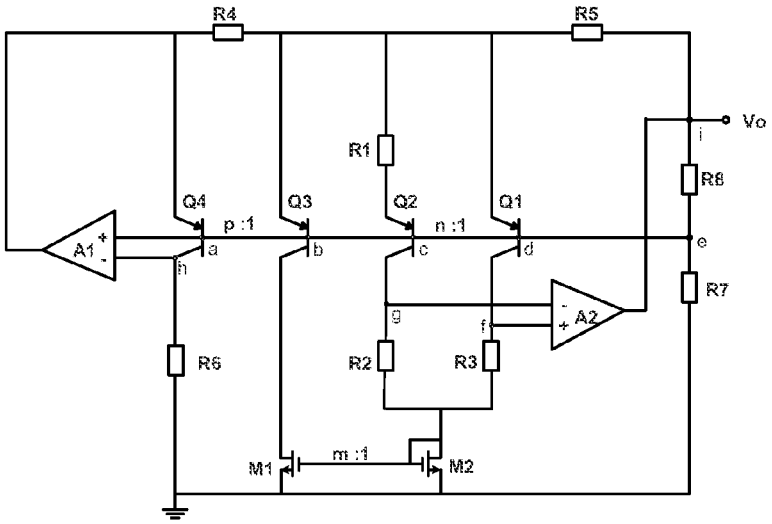
FIG. 3 is a diagram of Embodiment 2 of the voltage reference circuit based on temperature compensation in the present invention.

FIG. 3 is a diagram of embodiment 2 of the present invention. As shown in FIG. 3, the difference between Embodiment 1 and Embodiment 2 is as follows: resistor R1 connects the emitter of Q2, resistor R2 connects the collector of bipolar transistor Q2 and the drain of second MOS transistor M2, resistor R3 connects the collector of bipolar transistor Q1 and the drain of the second NMOS transistor M2, the positive input of operational amplifier A2 connects the collector of bipolar transistor Q1, and the negative input of operational amplifier A2 connects the collector of Q2 and resistor R2.

Embodiment 3

Figure 4:
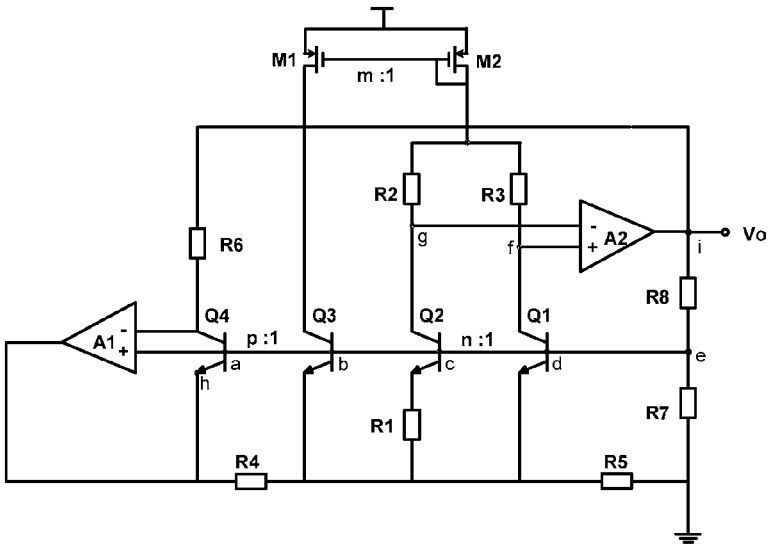
FIG. 4 is a diagram of Embodiment 3 of the voltage reference circuit based on temperature compensation in the present invention.

FIG. 4 is a diagram of Embodiment 3 of the present invention. As shown in FIG. 4, the difference between Embodiment 3 and Embodiment 2 is as follows: bipolar transistors Q1,Q2, Q3 and Q4 are NPN type; the first MOS transistor M1 and the second MOS transistor M2 are N-channel enhanced MOSFET, and the common connection for R5 and R7 are grounded.

Embodiment 4

Figure 5:
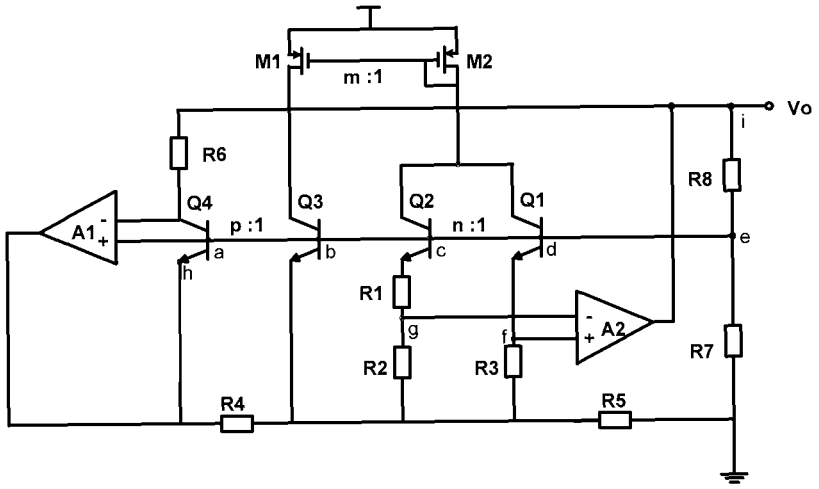
FIG. 5 is a diagram of embodiment 4 of the voltage reference circuit based on temperature compensation in the present invention.

FIG. 5 is a diagram of Embodiment 4 of the present invention. As shown in FIG. 5, the difference between Embodiment 4 and Embodiment 1 is as follows: bipolar transistors Q1, Q2, Q3 and Q4 are NPN type; the first MOS transistor M1 and the second MOS transistor M2 are N-channel enhanced MOSFET, and the common connection for R5 and R7 are grounded.

The foregoing preferred embodiments are provided to describe, not to limit, technical approaches in the present invention. Obviously, bearing the essence and concept of the present invention, technologists in this field can make various changes and modifications to the present invention. It should be understood that those changes and modifications are also covered by claims of the present invention, if they are with the same purpose and within the same scope of the present invention.

What is claimed is:

1. A temperature compensation based voltage reference circuit, comprising a positive temperature coefficient generating unit, a negative temperature coefficient generating unit, a temperature compensation circuit, mirror circuit and a voltage divider, wherein;

the positive temperature coefficient generating unit generates a positive temperature coefficient voltage comprising Item T ln (T), and outputs a positive temperature coefficient current comprising Items T and T ln (T);

the negative temperature coefficient generating unit generates a negative temperature coefficient voltage comprising Item T ln (T), and outputs a positive temperature coefficient current comprising Item T;

the temperature compensation circuit converts a positive temperature coefficient current comprising Items T and T ln (T) into a positive temperature coefficient voltage comprising Items T and T ln (T), and compensates negative temperature coefficient voltage comprising Items T and T ln(T) generated by negative temperature coefficient generating unit, which, together with temperature compensation circuit, generates a reference voltage with zero temperature coefficient;

Wherein, T is absolute temperature;

the mirror circuit multiplies output current from the negative temperature coefficient generating unit by a factor of m, which is then input into the positive temperature coefficient generating unit;

the voltage divider adjusts output voltage and calculates operating voltages of both positive and negative temperature coefficient generating units.

2. A voltage reference circuit based on temperature compensation according to claim 1 features:

the temperature compensation circuit comprising resistor R5, the positive temperature coefficient generating unit comprising operational amplifier A1, bipolar transistors Q3, Q4, resistors R6 and R4, wherein, the positive input of operational amplifier A1 is connected to the base of Q4, and the negative input is connected to its collector, and the output of operational amplifier A1 is connected to the emitter of Q4, and one end of resistor R6 is connected to the negative input of A1 and collector of Q4, the other end of R6 is grounded, and resistor R4 is between emitter of Q4 and emitter of Q3, the collector of Q3 is connected with the mirror circuit, and the base of Q3 is connected to base of Q4.

3. The voltage reference circuit based on temperature compensation according to claim 2, features:

the negative temperature coefficient generating unit comprising operational amplifier A2, bipolar transistors Q1 and Q2, resistor R1,R2 and R3, where the emitter of Q1 is connected to the positive input of A2, which is connected to R3, the emitter of Q2 is connected via R1 to negative input of A2, which is connected to R2, the output of A2 is connected to R5, of which the other end is connected to R2 and R3, and the other end of R2 is connected to the emitter of Q3, and collectors of Q1 and Q2 are connected with the other end of mirror circuit, and the output of A2 is connected to voltage divider.

4. The voltage reference circuit based on temperature compensation according to claim 3 features:

the mirror circuit comprising first NMOS transistor M1 and second NMOS transistor M2, wherein the sources of the first MOS transistor M1 and second MOS transistor M2 are grounded, the gates of M1 and M2 are connected with each other, the gate of M2 is connected to the drain of M2, the drain of M1 is connected to the collector of Q3 and the gate of M2 is connected to collectors of Q1 and Q2.

5. The voltage reference circuit based on temperature compensation according to claim 4 features:

the voltage divider comprising resistors R7 and R8, wherein R8 is connected to the output of A2, and the other end of R8 is connected to R7 and bases of Q1, Q2, Q3 and Q4, the other end of R7 is connected to sources of M1 and M2, the connecting node of A2 with R5 and R8 is the output port of the reference circuit, Vo.

6. The voltage reference circuit based on temperature compensation according to claim 5 features:

A reference voltage output Vo determined by the ratio of $R_7$ and $R_8$: $V_o=(E_g/q)\cdot(1+R_7/R_8)$, where $(E_g/q)$ is the bandgap voltage of silicon, and different output reference voltages by adjusting the ratio of R7 and R8.

7. The voltage reference circuit based on temperature compensation according to claim 6 features:

R4 and R5 expressed as:

$$\frac{R_5}{R_4} = \frac{3}{2}.$$

8. The voltage reference circuit based on temperature compensation according to claim 7 features:

the negative temperature coefficient generating unit comprising at least 1 bipolar transistor Q1 and at least 1 bipolar transistor Q2, wherein the ratio of the number of all Q2 to all Q1 is n;

the positive temperature coefficient generating unit comprising at least 1 bipolar transistor Q3 and and 1 bipolar transistor Q4, wherein the ratio of the number of all Q4 to all Q3 is p, where, n>1, p>1.

* * * * *